US005116451A

United States Patent [19]

LeCompte

[11] Patent Number: 5,116,451

[45] Date of Patent: May 26, 1992

[54] FLOW THROUGH IMPREGNATION OF DEEP NESTED FIBER OPTICAL CANISTER

[75] Inventor: George W. LeCompte, Tucson, Ariz.

[73] Assignee: Hughes Aircraft Company, Los Angeles, Calif.

[21] Appl. No.: 575,103

[22] Filed: Aug. 29, 1990

[51] Int. Cl.[5] ..... B65H 81/02

[52] U.S. Cl. ..... 156/441; 156/305; 156/169; 242/173; 427/238

[58] Field of Search ..... 156/305, 169, 166, 87, 156/441, 433; 242/173; 427/238, 235, 177, 178

[56] References Cited

U.S. PATENT DOCUMENTS

| | | | |
|---|---|---|---|
| 1,973,080 | 9/1934 | Johnson | 427/235 |
| 3,336,175 | 8/1967 | Nutt et al. | 264/279 |
| 3,765,926 | 10/1973 | Ramachandran | 156/305 |
| 3,783,180 | 1/1974 | Spicer | 242/173 |
| 4,061,522 | 12/1977 | Bauerkemper | 156/305 |
| 4,152,173 | 5/1979 | Jackson et al. | 427/235 |
| 4,276,333 | 6/1981 | Cobean | 156/305 |
| 4,344,808 | 8/1982 | Healey, Jr. et al. | 156/166 |
| 4,950,049 | 8/1990 | Darsey et al. . | |

FOREIGN PATENT DOCUMENTS

| | | | |
|---|---|---|---|
| 1406255 | 6/1988 | U.S.S.R. | 156/166 |

*Primary Examiner*—Michael W. Ball
*Assistant Examiner*—Daniel J. Stemmer
*Attorney, Agent, or Firm*—R. M. Heald; C. D. Brown; W. K. Denson-Low

[57] ABSTRACT

According to the invention, a method and system of injecting material into a wound filament items such as a fiber optic canister is provided. The method is useful with a canister which, when dry wound, has at least one channel formed therein.

In one aspect, the method includes the step of injecting adhesive into the channel to impregnate the canister with adhesive. In another aspect, the method includes the additional step of discharging adhesive from a second channel to remove excess adhesive from the canister. The method may also include the step of circulating air through the two channels to purge excess adhesive and solvent.

In another aspect, the invention comprise a system for producing wound filament items and includes a winding system for forming a dry wound filament item having at least two open channels; a fixture for receiving the dry wound filament item; and a hydraulic system for injecting adhesive into one chanel to impregnate the item with adhesive and for discharging adhesive from the second channel to remove excess adhesive from the item. The production system may also include a seal for preventing adhesive from leaking from the time during the impregnation and pruging steps. and purging steps.

4 Claims, 3 Drawing Sheets

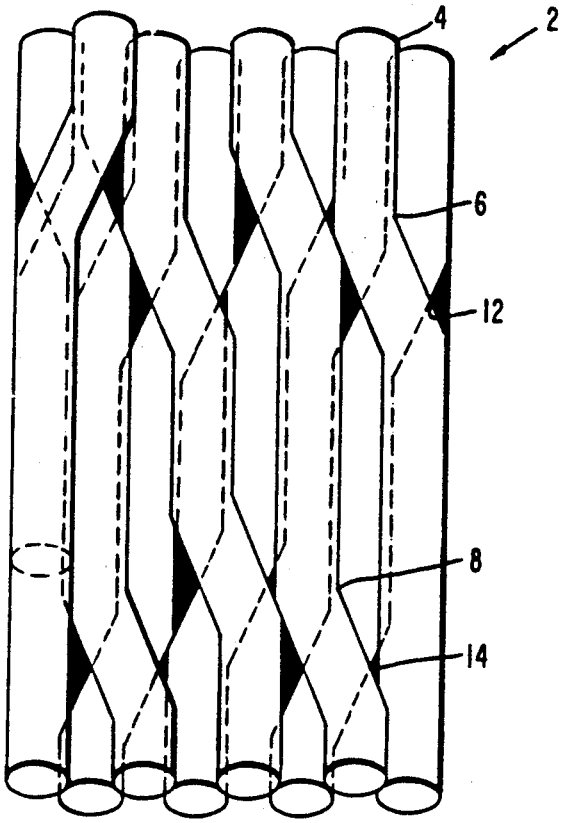
Fig. 1
Fig. 2.
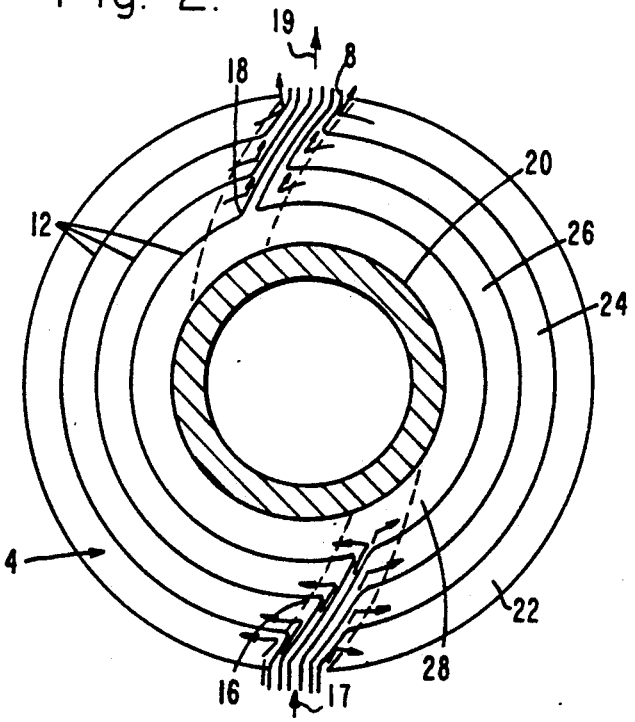
Fig. 3a.
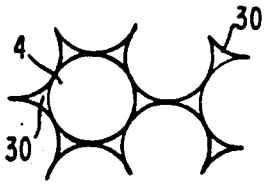
Fig. 3b.
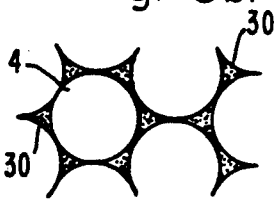
Fig. 3c.
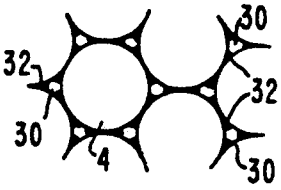

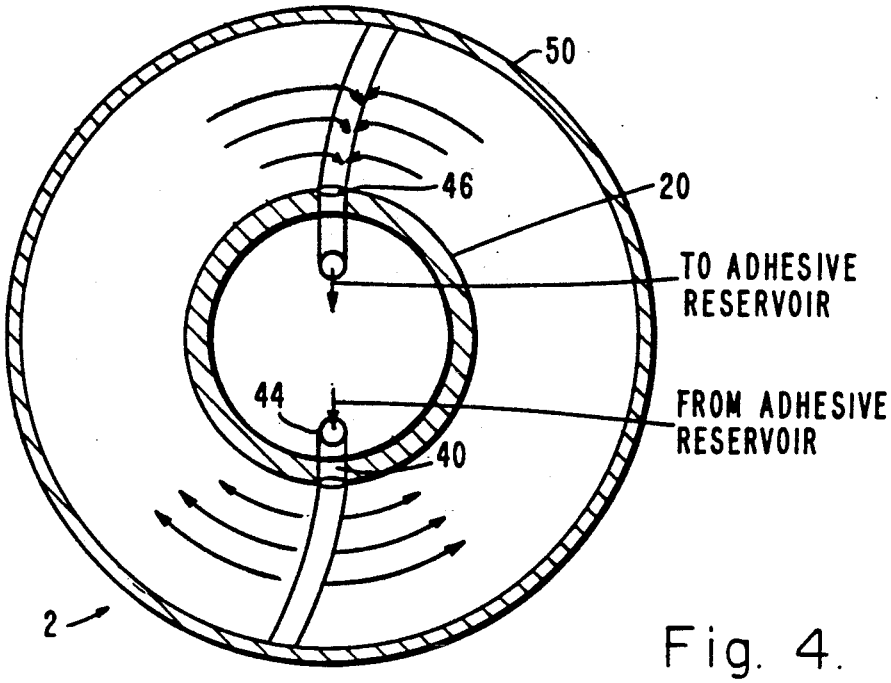
Fig. 4.
Fig. 5.
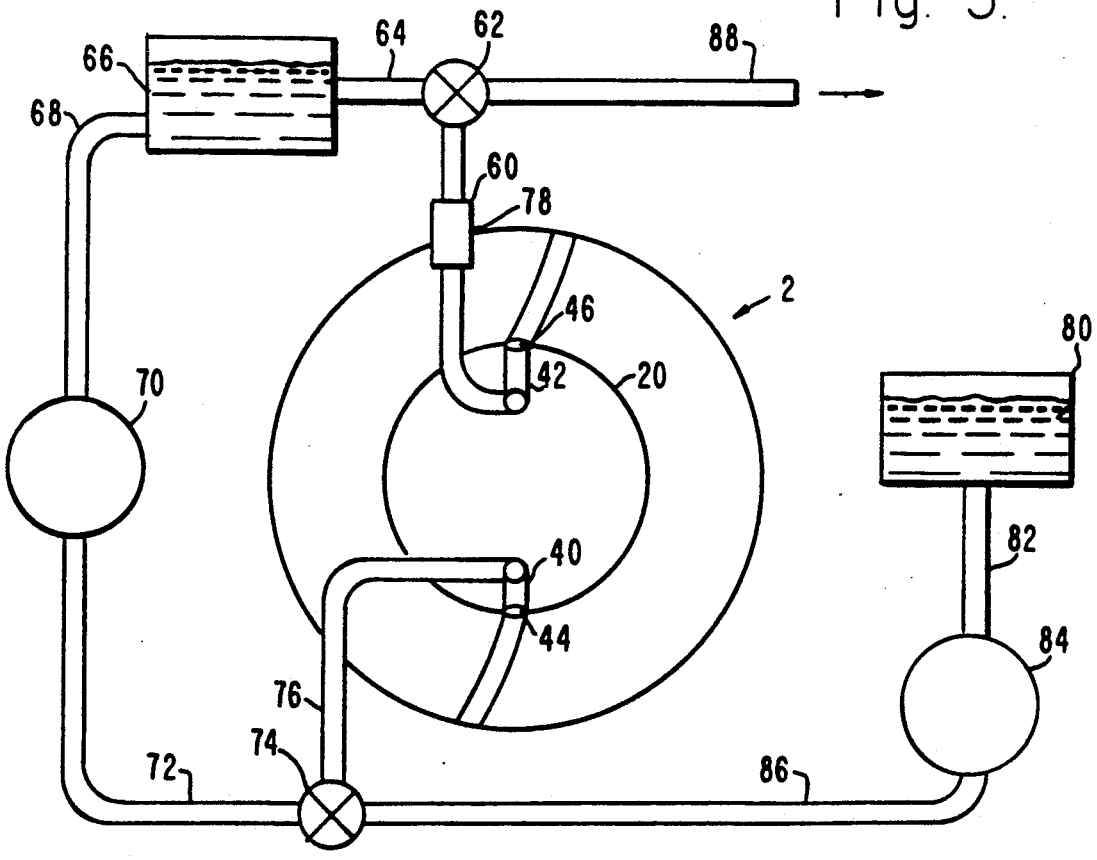

FLOW THROUGH IMPREGNATION OF DEEP NESTED FIBER OPTICAL CANISTER

BACKGROUND OF INVENTION

1. Technical Field

This invention relates to a method of applying adhesive to a fiber optic canister. More particularly, a fiber optic canister is formed having at least two open channels. Adhesive is injected into at least one channel to impregnate the canister with adhesive.

2. Discussion

Wound optical fibers and wound wire coils are commonly used in military and communication applications. Typically, optical fibers are densely wound, layer by layer onto bobbins, to form extremely long wound filament items referred to as fiber optic coils, canisters, packs, etc. These items are often designed and wound to be useful in high speed payout applications.

It is known that high density deep nested filament winding techniques give rise to the formation of crossover regions in each filament layer. These regions are continuous from layer to layer and form natural open channels from the first layer through the last layer in a wound canister.

Many techniques used to form high density canisters require that an adhesive be used to enhance shelf life and to ensure that the filament peels off with proper control during payout. Unfortunately, the application of adhesive during winding is attended by several problems. For example, in one commonly used technique, adhesive is applied after each filament layer is wound. However, layer to layer application of adhesive requires that the winding process stop temporarily and thus prevents high speed production of canisters. In addition, adhesive tends to accumulate in the crossover regions (channels) which can cause problems during payout. Moreover, adhesive is often applied by spraying, which is very messy and can require the use of special shields to prevent inadvertent spraying of adhesive onto equipment, etc.

Another method of applying adhesive involves vacuum impregnation of a dry wound canister with adhesive. With this method, the canister is first dry wound without any adhesive, and then adhesive is injected into the entire item using a vacuum. This technique requires the use of a volatile solvent to reduce the viscosity of the adhesive so that the adhesive will flow in the vacuum. Unfortunately, many solvents actually boil off in such vacuums, resulting in the application of too much adhesive to the winding. One way around the problem of applying too much adhesive is to use a weak adhesive; however a weak adhesive is unacceptable in many military applications. In addition, a vacuum is ineffective in removing any excess adhesive which may have accumulated in the canister.

The use of an in line pressureless die to apply adhesives during winding of canister is also known. However, this approach requires expensive equipment and careful control to maintain adhesive uniformity. Moreover, reversal of the in line die process to correct for errors during winding is extremely difficult.

SUMMARY OF THE INVENTION

According to the invention, a method and system of applying a material (such as an adhesive) to a wound filament item (such as a fiber optic canister) is provided. The method is useful with canisters or coils which, when dry wound, have at least one channel formed therein.

In one aspect, the method includes the step of injecting adhesive into one channel of the canister to impregnate the canister with adhesive. In another aspect, the method includes the additional step of discharging adhesive from a second channel to remove excess adhesive. The method may also include the step of circulating air through both channels to purge the canister of excess adhesive and solvent.

In another aspect, the invention comprises a system for producing wound filament items such as canisters. The system includes a winding system for forming a dry wound filament item having at least two channels; a fixture for receiving the dry wound filament item; and a hydraulic system for injecting adhesive into one channel to impregnate the item with adhesive and for discharging adhesive from the other channel to remove excess adhesive. The system may also include a seal for preventing adhesive from leaking from the item during impregnation.

The invention has numerous advantages over the prior art. For example, solvent born adhesives can be employed without the risk of vaporization since the adhesives are not applied under a vacuum. In addition, excess solvents and adhesive can be quickly and thoroughly removed from the canister by circulating air or a cleaning fluid through the channels. The resulting substantially open channels help to dissipate high pressures which may be exerted on the canister, for example, during undersea applications, further resulting in minimal distortion of the filament.

The amount of adhesive applied can be controlled by varying the adhesive-solvent proportions and the force of and duration of the impregnation and purging steps.

More importantly, the application of adhesive is separated from the process of winding the optical fiber. This permits a fiber winding machine to operate at maximum speed without requiring disruption for applying adhesives.

Additional advantages of the invention will become apparent in view of the following brief description of the drawings, the detailed description and the appended claims.

BRIEF DESCRIPTION OF THE DRAWINGS

FIG. 1 depicts a deep nested fiber optic canister.

FIG. 2 is a cross-sectional view of a canister undergoing flow through impregnation of adhesive according to the invention.

FIGS. 3A–3C are cross-sectional views of a canister at various stages of formation according to the invention.

FIGS. 4 and 5 are systems for injecting and removing adhesive according to various embodiments of the invention.

DETAILED DESCRIPTION

Figure 6:
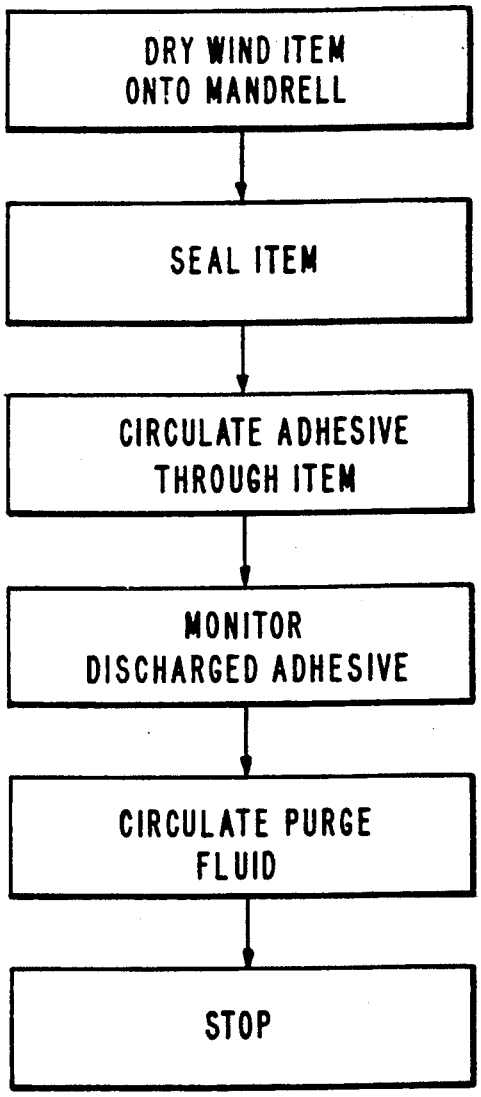
FIG. 6 shows in summary form a method for impregnating a dry wound filament item.

The invention will now be explained first by reference to an illustration of the crossover regions formed in a typical deep nested fiber optic canister. The invention will then be further explained by reference to several techniques for circulating adhesive and purging fluids through these channels to create an impregnated canister. Although the invention will be explained by reference to specific embodiments, it should be understood that the following description is for illustration only and should not be considered to otherwise limit the invention.

Refer now to FIG. 1 which is a stylized illustration of a portion of a fiber optic canister 2. Canister 2 may be a typical deep nested filament winding formed of wound filaments 4. For the purposes of the invention, the term "filament" includes optical fiber, wire, and the like and the terms "wound item" and "item" include fibers, wires, and other filaments wound so as to form canisters, packs, or coils.

In canister 2, fibers 4 are wound layer upon layer in a tightly packed, dense configuration. Typically, a top layer 6 will be nested into a bottom layer 8. In addition, the top layer 6 will cross over the bottom layer at least two crossover regions per layer. The crossover regions are shown in FIG. 1 as regions 12 and 14. Crossover regions 12 and 14 are characterized as shaded triangular areas and form openings through the finally wound item. As additional layers of filament (not shown) are successively wound over layers 6 and 8, the crossover regions in such additional layers will be formed in alignment with crossover regions 12 and 14, with only a slight shift in the crossover regions from layer to layer. The resulting continuously connected crossover regions form a pair of channels which run through the entire pack from inside to outside. According to the invention, these naturally occurring channels are used to inject a material such as an adhesive into a fully wound, dry filament item.

Refer now to FIG. 2 which shows one arrangement for injecting adhesive into a dry wound fiber optic canister and for removing adhesive from a dry wound fiber optic canister according to the invention. As shown in FIG. 2, a dry wound canister 2 is mounted on a mandrel 20. Channels 16 and 18 are used for injecting adhesive into canister 2 at a channel input 17 and for removing excess adhesive from canister 2 at a channel output 19. Adhesive is injected into canister 2 under pressure at channel input 17 into channel 16 and impregnates canister 2 along flow paths 22, 24, 26 and 28 formed by the spaces between filaments 4 which make up the fiber pack. Adhesive is forced along flow paths 20, 24, 26 and 28, into channel 18, and out of the item at channel output 19.

The outer surface of the canister may be sealed by wrapping with tape or a similar resilient barrier material to contain the adhesive. This seal can also be reinforced by over winding with wire or a similar material to assure adequate strength and sealing to counterbalance the pressure of impregnation.

After canister 2 has been impregnated with a suitable amount of adhesive, the injection of the adhesive into the channel input 17 is stopped and the use of a purging fluid such as air, is started. The purging fluid may be injected into channel input 17, forced along flow paths 22, 24, 26 and 28, and discharged from the wound item 2 at channel output 19.

The out flow from channel output 19 can be carefully monitored while adhesive is being injected to determine when the item has been impregnated with a suitable amount of adhesive. For example, one indication of the complete filing of the flow paths with adhesive is the lack of air bubbles in the adhesive discharge from channel output 19. When canister 2 has been adequately impregnated with adhesive (as evidenced by lack of air in the adhesive discharge), a purging fluid may then be circulated through canister 2 to eject excess adhesive from the crossover regions. The amount of adhesive left in the item will be determined by the viscosity of the adhesive fluid solution, its surface tension, and the degree to which the adhesive wets the surface of the item. Circulation of a purge gas such as air through canister 2 will not only remove excessive adhesive but will also remove any evaporating solvent and facilitate interior drying of canister 2.

Refer now to FIGS. 3A-3C which are stylized cross-sectional views of filaments 4 when wound dry, impregnated, and subsequently purged. As shown in FIG. 3A, when canister 2 is dry wound, spaces 30 are formed between the various filaments 4. During impregnation, these spaces 30 are filled with adhesive. After purging, a meniscus of adhesive 32 will be formed in the corners of these spaces 30. The amount of residual adhesive left in the item will determine the peel characteristics when the filament is paid out during actual use.

Refer now to FIG. 4 which is a cross-sectional view of another system for injecting adhesive into a dry wound canister 2 and for removing adhesive from canister 2 according to another embodiment of the invention. As shown in FIG. 4, adhesive is injected into and removed from canister 2 at inside channel inputs 44 and 46. This is in contrast to the arrangement in FIG. 3 where adhesive was injected and removed from channel inputs along the outside of the item. The arrangement as shown in FIG. 4 uses a continuous, one piece seal 50 and requires openings in the mandrel 20. An adhesive input line 40 from an adhesive reservoir (not shown) is coupled to inside channel input 44 and an adhesive output line 42 is coupled to channel output 46. Output line 42 will return adhesive to the adhesive reservoir (not shown).

Refer now to FIG. 5 which shows a complete system for injecting adhesive into a canister 2 and for purging excess adhesive from canister 2. As shown in FIG. 5 a dry wound canister 2 is mounted on and sealed along its interior surface by a mandrel 20. The exterior surface of canister 2 is sealed on its exterior surface by a seal 50. Adhesive and purge fluid are injected into input channel 44 by an input manifold 40. Excess adhesive and purged fluid is recovered from output channel 46 by an output manifold 42.

The circulation of adhesive solution through canister 2 will now be discussed. Initially, adhesive flows through an output line 60 to a transfer valve 62. One output of a transfer valve 62 is connected by a supply line 64 to an input of an adhesive reservoir 66. The adhesive reservoir 66 contains a quantity of adhesive and thinning agents (i.e., solvents). An output line 68 from adhesive reservoir 66 is coupled to an input side of pump 70. An output line 72 carries adhesive from an output of pump 70 to an input of another transfer valve 74. The output of transfer valve 74 is coupled to input manifold 40 to inject the adhesive solution under pressure into input channel 44. As previously explained, the adhesive solution flows around flow paths in canister 2 and exits the canister at output channel 46.

The circulation of purged fluid will now be discussed. Adhesive solution flowing in the adhesive circulation loop should be sampled to determine air content or other characteristics to determine when the canister 2 has been sufficiently impregnated with adhesive. For this purpose, a monitor 78 may be coupled to adhesive line 64. When the air content falls below a certain detectable level, i.e. is near zero, canister 2 is suitably impregnated with adhesive.

When canister 2 has been adequately filled with adhesive, transfer valve 74 is reset to inject purge fluid over a line 76 to manifold 40 and into channel opening 44. Purge fluid is then supply circulated under pressure through canister 2 forcing adhesive and purge fluid out of canister 2, at channel opening 46. The purge fluid will then flow over output line 60 and into transfer valve 62. An output line 88 conveys waste purge fluid and adhesive to a disposal unit not shown.

The purge fluid can be provided from a reservoir such as purge fluid reservoir 80 and coupled over a hydraulic line 82 to an input side of pump 84. The output of pump 84 is coupled by a hydraulic line 86 to an input side of transfer valve 74.

When all the purge fluid is used up, after a predetermined time, or upon a monitor detecting a certain minimum amount of adhesive in the purge fluid, another fluid could be circulated through canister 2. For example, if a liquid fluid were first used to purge canister 2 of adhesive, a follow-up purge using air or another gaseous mixture may be used to quickly dry the wound item.

Refer now to FIG. 6. FIG. 6 shows in summary form a method for impregnating a dry wound filament item (canister, etc.) with adhesive according to another embodiment of the invention. As shown in FIG. 6 the method includes the step of first dry winding a filament onto a mandrel. Next, the dry wound filament item is sealed.

After a source of adhesive and a hydraulic system for circulating adhesive are provided, adhesive is circulated through the wound item to impregnate the wound item with adhesive. In the next step discharge adhesive is monitored to determine when substantially all of the air has been forced out of the wound item.

After a source of purged fluid and a system for circulating the purged fluid through the filament item are provided, next a purge fluid is circulated through the filament item to remove excess adhesive from the item.

Although the invention has been explained by reference to the foregoing embodiments, it should be understood that other variations and modifications can be made to the foregoing without departing from the scope and spirit of the invention. For example, it should be understood that the term "fluid" as used herein includes both liquids and gasses. It should be further understood that the invention may be used to impregnate a fiber optic canister with other materials than adhesives. It should be also understood that in its broadest context, the invention is applicable to the general problem of fabricating wound filament items for military and commercial applications. Thus, the invention should be limited only in accordance with the appended claims.

What is claimed is:

1. A pressurized system for injecting a controlled amount of adhesive throughout a dry wound filament pack having multiple layers with each succeeding layer having turns deeply nested between turns of a preceding layer such that at least first and second separate channels formed from continuously connected crossover regions in each filament layer extend through all layers of the pack, and comprising;

the filament pack having an exterior surface formed by an outermost filament layer and an interior surface formed by an innermost filament layer;

a layer of sealing material enclosing the pack exterior surface to prevent adhesive from being inadvertently expelled outwardly from the pack;

mandrel means for supporting said filament pack while simultaneously sealing the pack interior surface to prevent adhesive from being inadvertently expelled inwardly from the pack;

an input manifold in direct fluid communication with an end of the first channel through an opening in either the exterior sealing layer or the mandrel means and an output manifold in direct fluid communication with an end of the second channel through an opening in either the exterior sealing layer or the mandrel means;

adhesive supply means in fluid engagement with the input manifold for injecting adhesive through the first channel and into and throughout the dry wound filament pack; and said adhesive supply means also in fluid engagement with the output manifold for recovering excess adhesive expelled from the filament pack through the second channel and output manifold.

2. The pressurized system of claim 1, wherein said adhesive supply means comprises an adhesive reservoir and a series of conduits including a first conduit extending between the reservoir and the input manifold and a second conduit extending between the output manifold and the reservoir.

3. The pressurized system of claim 2, wherein said adhesive supply means further comprises a pump assembly in fluid communication with the first conduit for pumping adhesive from the reservoir through the input manifold and into the first channel of the dry wound filament pack.

4. The pressurized system of claim 1, further comprising means for injecting a purge fluid through the input manifold, first channel and throughout the wound filament pack, thereby forcing excess adhesive from the impregnated filament pack and into the second channel.

* * * * *